United States Patent [19]

Kohl

[11] 3,931,911

[45] Jan. 13, 1976

[54] ICE DISPENSING MACHINE

[75] Inventor: Vance L. Kohl, Albert Lea, Minn.

[73] Assignee: King-Seeley Thermos Co., Ann Arbor, Mich.

[22] Filed: Dec. 17, 1973

[21] Appl. No.: 425,103

Related U.S. Application Data

[63] Continuation-in-part of Ser. No. 205,215, Dec. 6, 1971, Pat. No. 3,796,351.

[52] U.S. Cl. ..... 222/56; 200/61.21; 200/153 T

[51] Int. Cl.[2] ..... B67D 5/14

[58] Field of Search ..... 222/162, 168, 56; 200/61.21, 153 T, 61.2

[56] References Cited

UNITED STATES PATENTS

| | | | |
|---|---|---|---|
| 2,952,391 | 9/1960 | Garland | 222/162 X |
| 3,287,516 | 11/1966 | Nielsen | 200/153 T |
| 3,406,871 | 10/1968 | Hoenisch | 222/168 X |

*Primary Examiner*—Allen N. Knowles
*Assistant Examiner*—Hadd Lane
*Attorney, Agent, or Firm*—Harness, Dickey & Pierce

[57] ABSTRACT

An apparatus for receiving flaked or particulate ice from an associated ice making machine and adapted to selectively dispense the ice into a glass or similar receptacle, the apparatus including a rotatable ice storage bin, means defining a discharge opening below the storage bin and communicable with a discharge spout, means for causing rotation of the bin and for communicating ice therefrom through the discharge opening and into the receptacle, and means for sensing the quantity of ice in the bin and for effecting operation of the ice making machine when the volume of ice within the storage bin drops below some preselected magnitude.

7 Claims, 9 Drawing Figures

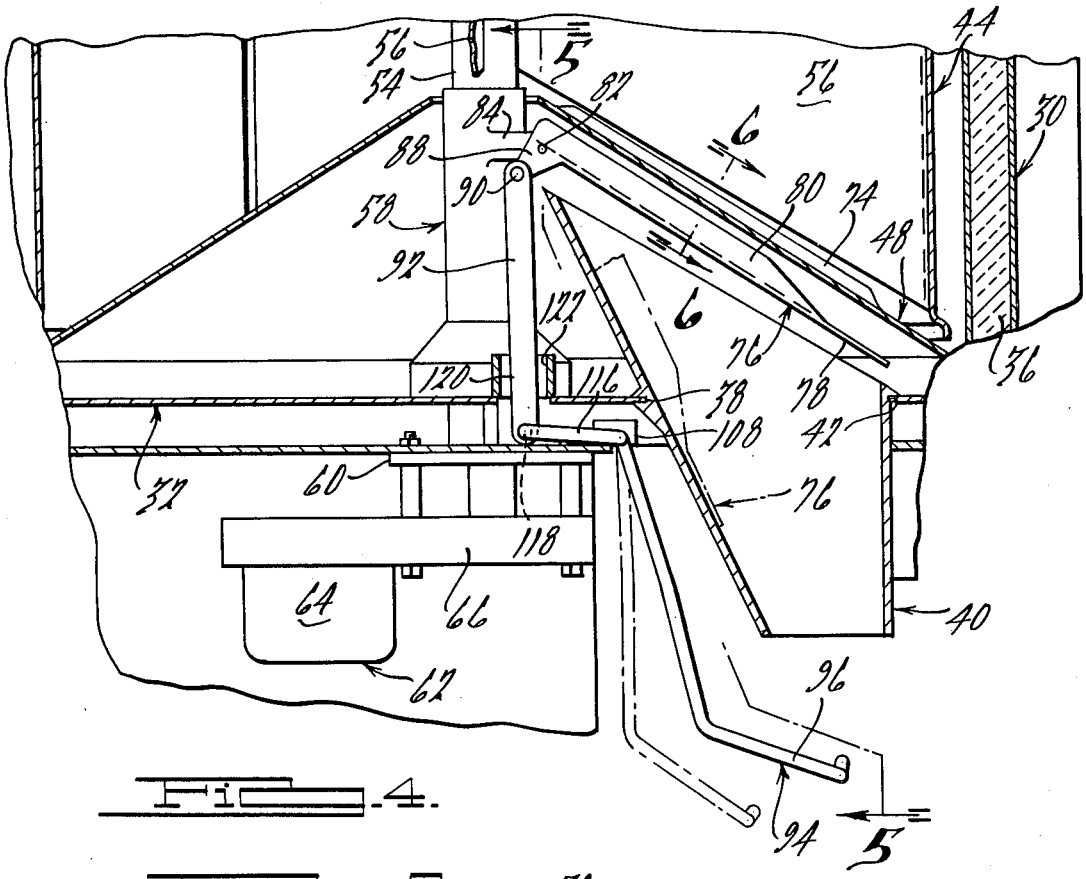
FIG. 4.
FIG. 5.
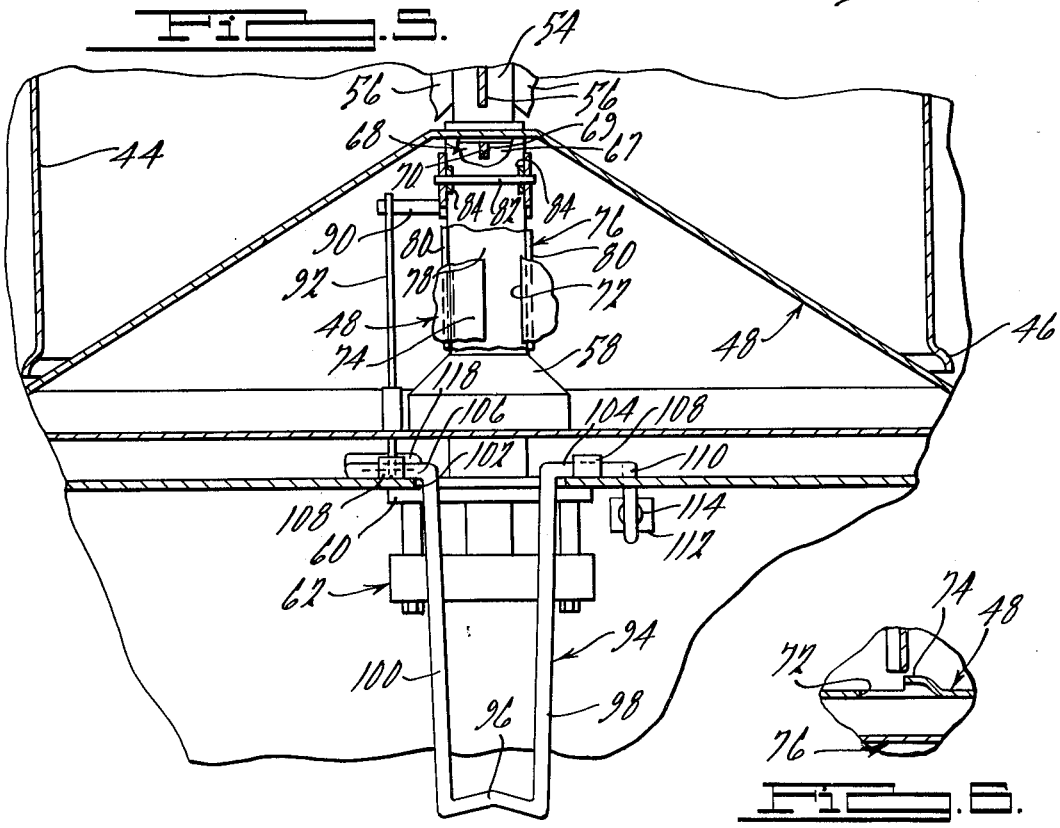
FIG. 6.

ICE DISPENSING MACHINE

RELATED APPLICATIONS

This is a continuation-in-part application of Ser. No. 205,215, filed Dec. 6, 1971, now U.S. Pat. No. 3,796,351 of Mar. 12, 1974, for Ice Dispensing Machine.

BACKGROUND OF THE INVENTION

Generally speaking, the particulate ice dispensing apparatus of the present invention comprises an ice storage bin that is rotatably mounted within a dispensing housing and within which a mass or volume of particulate ice is stored prior to being discharged therefrom. At such time as it is desired to dispense particulate ice from the storage bin, the entire mass of stored ice is rotated over a stationary discharge spout supported in a plate adjacent the lower end of the ice mass, this plate being provided with means for shearing ice from the lower end of the mass in the event that there exists any adhesion or "bridging" between the ice particles.

More particularly, the present invention is concerned with certain improvements over the flaked ice dispenser shown and described in U.S. Pat. No. 3,406,871, issued Oct. 22, 1968, which generally shows an ice dispensing machine of the above described type, but which includes a shutter assembly that is rotatable with the ice storage bin to selectively close or block the flow of ice and incidental melt water between the discharge opening in the bin and the discharge spout. One feature of the present invention is the ability to utilize a novel ice discharge chute in place of the aforementioned shutter assembly and which is adapted to be selectively actuated by means of a receptacle actuated control lever that depends downwardly into the dispensing cavity of the machine directly below the ice discharge spout. The discharge chute normally assumes a position below the discharge opening whereby any ice or melt water which may drop downwardly therethrough will be directed into an outer storage bin which is in turn communicable with a system drain, thereby positively preventing any ice or melt water from dropping downwardly through the discharge spout during periods of non-use. At such time as it is desired to dispense or vend a quantity of particulate ice, the aforementioned control lever is actuated by inserting a glass or other suitable receptacle below the discharge spout, whereby the control lever will effect energization of the drive motor controlling rotation of the storage bin, and simultaneously will effect movement of the discharge chute from the aforementioned position to a position guiding the downward flow of ice from the discharge opening into the discharge spout, as will hereinafter be described in detail.

Another feature of the present invention resides in the shape or configuration of the ice storage bin per se. In particular, the bin has its outer peripheral side wall tapered or inclined radially outwardly toward the lower end thereof, whereby to assure for the positive movement of flaked ice within the bin toward the dispensing or discharge opening at the lower end of the bin. Yet another feature of the present invention resides in the provision of a novel ice level sensing switch that is operatively mounted adjacent the upper end of the bin and is adapted to effect control of the associated ice making machine which supplies flaked ice to the storage bin. As will hereinafter be described in detail, the ice level sensing switch includes a unique mounting arrangement and back-up switch that enables fail safe operation of the present invention.

SUMMARY OF THE INVENTION

This invention relates generally to improvements in apparatus for storing and dispensing ice, and more particularly, to an extremely simple and compact apparatus for storing and dispensing ice in flaked or particulate form.

It is, accordingly, one object of the present invention to provide a new and improved ice dispensing apparatus featuring a novel ice discharge chute arrangement which functions to positively prevent ice and melt water from dropping downwardly through the ice discharge spout during periods of non-use, and which is movable to a position for guiding or directing ice from the discharge opening to the discharge spout during a vend cycle.

It is another object of the present invention to provide a new and improved ice discharge spout arrangement which is of a relatively simple design and which is therefore economical to manufacture, easy to assemble and which will have a long and effective operational life.

It is still another object of the present invention to provide an improved particulate ice dispensing machine of the above character that facilitates the handling of particulate ice in a sanitary manner.

It is a more specific object of the present invention to provide a particulate ice dispensing apparatus of the above character wherein the ice is stored and delivered without contact with human hands and other possible sources of contamination.

It is a further object of the present invention to provide a new and improved ice dispensing machine of the above described type wherein the rotatable ice storage bin is simultaneously actuable with actuation of the ice discharge chute.

It is still a further object of the present invention to provide a new and improved ice dispensing machine of the above character wherein both the ice discharge chute and drive motor for rotating the ice storage bin are actuated upon engagement of an ice receiving receptacle with a control lever located within the dispensing cavity of the machine.

It is still a further object of the present invention to provide a particulate ice dispensing machine which may be easily installed and readily assembled and disassembled for cleaning and the like without the use of any special tools.

It is yet another object of the present invention to provide a new and improved ice dispensing machine having a rotatable ice storage bin, the outer side wall of which is of a relatively tapered or inclined configuration to permit the smooth unobstructed passage of ice toward the lower discharge end of the bin.

It is still a further object of the present invention to provide a new and improved ice dispensing machine featuring an ice level control switch assembly including a primary and back-up switch for de-energizing the associated ice making machine at such time as the quantity of ice within the dispensing bin has reached a predetermined level.

Other objects and advantages of the present invention will become apparent from the following detailed description taken in conjunction with the accompanying drawings.

BRIEF DESCRIPTION OF THE DRAWINGS

FIG. 4 is an enlarged fragmentary cross sectional view of the ice discharge spout, discharge chute and discharge opening which cooperate with the ice storage compartment of the ice dispensing machine of the present invention;

FIG. 5 is an enlarged transverse cross sectional view taken substantially along the line 5—5 of FIG. 4;

FIG. 6 is a fragmentary cross sectional view taken substantially along the line 6—6 of FIG. 4;

DETAILED DESCRIPTION OF A PREFERRED EMBODIMENT

Figure 3:
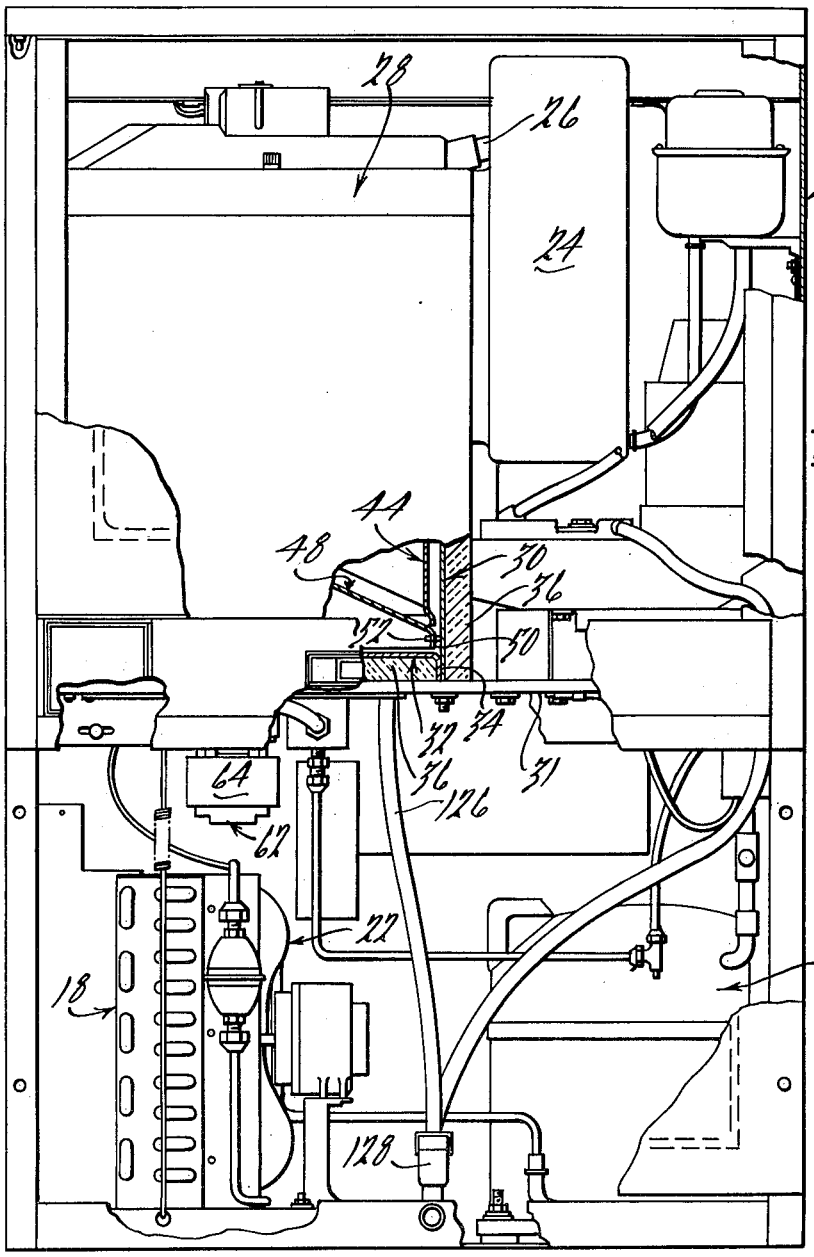
FIG. 3 is an enlarged cross sectional view, partially broken away, of the interior components of the ice dispensing machine of the present invention.

Referring now in detail to the drawings, a flaked or particulate ice dispensing machine 10, in accordance with one preferred embodiment of the present invention, is shown as comprising an exterior cabinet housing 12 which is formed with a dispensing cavity 14 and a drainboard 16 at the lower end of the front or forward side thereof. The housing 12 is adapted to contain a refrigeration system of the type well known in the art and includes a condenser 18, a compressor 20 and a cooling fan assembly 22. This refrigeration system serves to supply refrigerant to a particulate ice producing system 24 of conventional design and located in the upper end of the cabinet 12 (see FIG. 3). The refrigeration system may also be used to cool a liquid, such as drinking water or the like, to be dispensed through a suitable conduit or the like located within the discharge cavity 14, as is well known in the art. An ice chute or spout 26 is provided in the upper end of the cabinet 12 and is adapted to communicate particulate ice produced by the system 24 to an ice dispensing or vending assembly, generally designated by the numeral 28. As best seen in FIG. 3, the assembly 28 is mounted in the front or forward portion of the cabinet 12 and functions to selectively dispense preselected quantities of ice in particulate form to a suitable receptacle disposed within the dispensing cavity 14, in a manner hereinafter to be described.

It may be noted that while the particular arrangement of the aforementioned refrigeration and ice producing components is not essential to advantageous use of the various features of the present invention, their combination with the storage and dispensing portions of the hereinafter to be described ice vending assembly 28 provide a completely self-contained unit that will serve to conveniently and economically furnish ice in flaked or particulate form, without exposing such ice to any source of contamination. It will further be noted that the ice producing system 24 per se does not constitute a material part of the present invention and therefore will not be described in any further detail. By way of example, this system may be of the type shown and described in Trow et al., U.S. Pat. No. 2,753,694, issued July 10, 1956, which is incorporated herein by reference as a part of the descriptive portion of this specification.

Referring now to FIGS. 4 and 5, the ice vending assembly 28 is shown as comprising an elongated, generally cylindrically shaped outer bin 30 which is supported on a suitable structure or platform 31 in the position shown in FIG. 3. The lower end of the bin 30 is closed by an annular bottom closure member 32 which is preferably, although not necessarily, fabricated of stainless steel, or an equivalent corrosion resistant material, such as molded plastic or the like, the member 32 providing a fluid tight closure at the lower end of the bin 30 and being supported therein by having a downwardly extending flange section 34 fixedly secured within the inner periphery of the bin 30. A suitable insulating material, generally designated by the numeral 36, is preferably provided around the outer periphery of the outer bin 30 and on the underside of the closure member 32, as illustrated. A generally radially extending, oval shaped opening 38 is formed in the bottom closure member 32 within which is supported a downwardly projecting particulate ice outlet or discharge spout 40 that is formed with a peripheral groove or slotted section 42 which is adapted to nestingly receive the periphery of the opening 38, whereby to be operatively supported in the position shown in FIG. 4. As illustrated, the spout 40 extends downwardly below the platform 31, with the lower end thereof terminating within the upper end of the dispensing cavity 14. Disposed coaxially within the outer bin 30 is a particulate ice storage bin assembly comprising an inner bin 44 which is slightly smaller in diameter than the outer bin 30 and is mounted for rotary movement therewithin. The lower end of the inner or ice storage bin 44 is formed with an outwardly flared section 46 which serves to uniformly space the bin 44 from the inner periphery of the outer bin 30. Disposed directly below the storage bin 44 is an annular inner bottom plate or member 48 which is of a generally conical configuration, i.e., tapered radially inwardly and upwardly, and is formed with a generally cylindrical downwardly depending peripheral flange section 50 which is adapted to be detachably secured within the lower end of the outer bin 30 by means of a plurality of circumferentially spaced locking pins 52 which are adapted, for example, for bayonet locking engagement with suitable L-shaped slots or the like formed in the flange section 50, whereby to permit convenient removal of the member 48 for purposes of cleaning or the like, as will be apparent to those skilled in the art.

The inner or ice storage bin 44 is fixedly secured to an axially disposed, elongated central shaft 54 by means of a plurality (preferably three) of generally radially extending vanes or partition members, designated by the numeral 56. Each of the vane members 56 is formed with suitable transverse flange portions or the like on its radially inner and outer edges which flange portions are adapted to be fixedly secured to the central shaft 54 and inner periphery of the bin 44, thus providing a unitized rotatable assembly. The lower ends of the vanes 56 are inclined or tapered radially outwardly and downwardly from the shaft 54 toward the lower end of the bin 44 and thereby conform to the conical shape of the bottom member 48, as illustrated.

The shaft 54 is adapted to be operatively supported for rotational movement within the outer bin 30 by means of a generally annular or cylindrically shaped hollow support sleeve 58 which is mounted at the lower end of the bin 30 and extends generally axially upwardly therefrom. The sleeve 58 is fixedly secured at the lower end thereof to a support plate 60 which is secured, as by suitable screws, bolts or the like, to the platform 31, with the sleeve 58 projecting axially upwardly beneath the shaft 54 and being adapted to rotatably receive the lower end of the shaft 54 within the upper end thereof. Disposed below the ice vending assembly 28 is a drive motor assembly, generally designated by the numeral 62. The assembly 62 comprises a suitable electrically energized drive motor 64 which is adapted to drive a suitable gear train housed within an enclosure 66, the gear train 66 in turn being adapted to drive or rotate a generally vertically disposed shaft 67 which projects upwardly through the sleeve 58. Suitable coupling means, generally designated by the numeral 70, is provided between the upper end of the drive shaft 67 and the lower end of the shaft 54, whereby rotation of the drive shaft 67 upon energization of the motor 64 will effect rotation of the shaft 54 and hence rotation of the vanes 56 and the inner bin 44. Such coupling means is representatively illustrated in FIG. 5 as comprising a generally diametrically extending pin 69 provided on the lower end of the shaft 54, which pin 69 is adapted to be nestingly received within a suitable diametrically extending recess or slot 70 formed in the upper end of the drive shaft 67. It will be appreciated, of course, that various alternative drive arrangements may be utilized without departing from the scope of the present invention. By virtue of the aforedescribed coupling arrangement between the shaft 54 and shaft 67, the entire inner bin 44 may be conveniently removed for purposes of cleaning or the like.

As best illustrated in FIGS. 4 and 6, the inner bottom member 48 is formed with a particulate ice discharge opening 72 that extends radially from a point adjacent the central shaft 54 to a point adjacent the inner bin 44, the opening 72 being located directly above the ice discharge spout 40 that is supported in the bottom member 32, whereby particulate ice stored within the inner bin 44 may flow or drop under the influence of gravity directly through the opening 72 and spout 40 into a suitable receptacle, such as a glass or the like which is inserted into the dispensing cavity 14. The dispensing of ice is accomplished by rotating the inner bin 44, upon suitable actuation of the drive motor assembly 62, whereby the mass of particulate ice within the inner bin 44 is rotated relative to the inner bottom member 48. As best illustrated in FIG. 6, the portion of the inner bottom member 48 defining the far side of the discharge opening 72 (relative to the direction which the particulate ice is rotating) is slightly raised, whereby to define an ice shearing edge, herein designated by numeral 74. As the mass of particulate ice rotates relative to the inner bottom member 48, due to the aforementioned rotary movement of the inner bin 44, the lowermost particles of ice which do not drop through the discharge opening 72 under the influence of gravity are sheared from the moving mass and thereafter drop through the opening 72 and the discharge spout 40 into the aforesaid receptacle.

In accordance with the principles of the present invention, interposed between the underside of the inner bottom member 48 and the discharge spout 40 is an elongated ice discharge chute, generally designated by the numeral 76. The chute 76 comprises a generally flat or planar central portion 78 having a pair of upstanding side sections 80 formed along the longitudinally opposite sides thereof. The chute 76 extends generally radially outwardly from the support sleeve 58 at a position underlying the discharge openings 72, as best seen in FIG. 4. Generally speaking, during periods of non-use, the discharge chute 76 is disposed in the solid line position shown in FIG. 4, wherein the chute 76 is arranged generally parallel to the inner bottom member 48, i.e., slopes downwardly and outwardly. The length of the chute 76 is such that any ice or incidental melt water, which may have a tendency to drop downwardly from the ice mass within the inner bin 44 through the opening 72, will fall onto the chute 76 and be directed downwardly and outwardly beyond the outer portion of the discharge spout 40, with such ice or melt water being directed into the lower end of the outer bin 30 and be subsequently communicated to a suitable discharge drain or the like hereinafter to be described. At such time as the machine 10 is actuated, the chute 76 is adapted to be pivoted in a manner such that the outer end thereof moves downwardly or in a generally clockwise direction in FIG. 4 from the solid line position shown in this figure to the dotted or phantom line position. In this latter position, the chute 76 is adapted to guide the ice which drops downwardly through the opening 72 into the spout 40 for subsequent dispensing.

The aforesaid pivotal movement of the discharge chute 76 is provided by means of a generally horizontally disposed pivot pin 82 (see FIG. 5) which extends laterally through the side sections 80 at the upper end of the chute 76 and also through a pair of laterally spaced bosses 84 integrally formed on the support sleeve 58 at positions laterally outboard of the side sections 80. The chute 76 is formed with a generally downwardly projecting tab portion 88 adjacent the upper end thereof which is adapted to be pivotally connected via a suitable pivot pin or the like 90 to a downwardly projecting connecting or link member 92.

Figure 1:
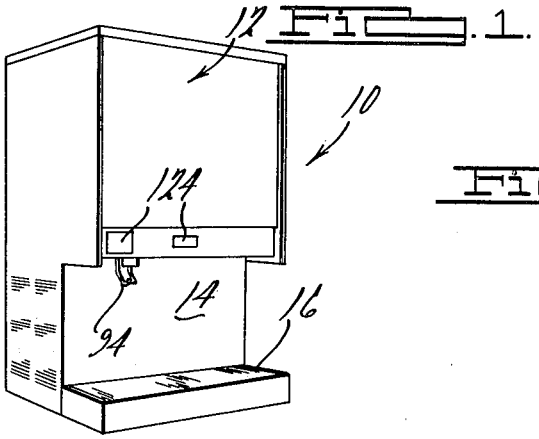
FIG. 1 is an elevated perspective view of an ice dispensing machine embodying the principles of the present invention.
Figure 2:
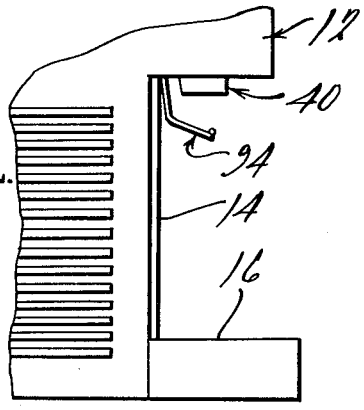
FIG. 2 is an enlarged fragmentary side elevational view of a portion of the dispensing cavity of the ice dispensing machine of the present invention.

As best shown in FIGS. 2 and 4, an elongated, generally U-shaped glass filler control element or lever depends downwardly into the dispensing cavity 14 at a position directly rearwardly of the discharge spout 40. The lever 94 is formed with a generally U-shaped lower end portion 96 which projects beneath the lower end of the discharge spout 40 to a position wherein a glass or other receptacle into which ice is to be dispensed may be engaged therewith. The lower end portion 96 of the lever 94 is formed with upwardly directed, laterally spaced, leg sections 98 and 100 which project through a suitable opening 102. The upper ends of the leg sections 98, 100 are formed with laterally outwardly extending integral support sections 104 and 106, respectively, which are adapted to be pivotably mounted on the upper side of the platform 31 by means of a pair of journal blocks generally designated 108, whereby the lever 94 is pivotable between the solid and dotted line positions shown in FIG. 4. The support section 104 is formed with a rearwardly and downwardly extending arm portion 110 which is cooperable with a control switch assembly, generally designated by the numeral 112. The assembly 112 comprises a depressable switch element 114 which is adapted to be engaged by the arm section 110 of the lever 94 in order to complete an electrical control circuit to the drive motor assembly 62. More particularly, at such time as the lever 94 is pivotably biased by means of a suitable glass or other receptacle from the solid line position shown in FIG. 4 to the dotted line position shown in this figure, the switch element 114 will be depressed by the section 110 to a position completing the aforesaid control circuit, thus effecting energization of the drive motor 64. Similarly, at such time as the aforesaid receptacle is removed, resulting in the lever 94 returning to the solid line position in FIG. 4 from the dotted line position, the switch element 114 will move to an open position, thus opening the electrical circuit to the drive motor 64 to effect de-energization of the same.

The support section 106 of the lever 94 is formed with a rearwardly extending arm section 116 having a generally laterally extending end portion 118 that is pivotably connected to a lower end portion 120 of the linkage member 92, the end portion 120 projecting downwardly through a suitable opening 122 as illustrated. By virtue of the operative connection of the control lever 94 with the chute 76 via the linkage member 92, at such time as the lever 94 is depressed, i.e., biased from the solid line to the dotted line position in FIG. 4, the linkage member 92 will be biased upwardly in FIG. 4, resulting in ice discharge chute 76 being pivoted downwardly from the solid line position to the phantom line position, as above described. It will thus be seen that at such time as the lever 94 is pivoted rearwardly, as above described, the switch assembly 112 will be actuated to effect energization of the drive motor assembly 62, and simultaneously, the discharge chute 76 will be pivoted from the position blocking the communication of particulate ice between the discharge opening 72 to the discharge spout 40, to a position providing such communication of particulate ice.

A detailed description of the overall control system of the machine 10 will not be given for purposes of conciseness of disclosure, it being sufficient to say that the machine 10 may typically be provided with a control system such as that shown and described in U.S. Pat. No. 3,406,871, which is incorporated by reference in the descriptive portion of this specification, such control system typically including a selector or vend control switch 124 mounted on the cabinet 12 and providing, for example, for the dispensing of continuous ice upon depressing the lever 96, the dispensing of metered ice (preselected quantities) and/or the simultaneous or separate dispensing of cooled drinking water. Assuming that the switch or switches 124 have been properly selected or positioned, the operator may place a receptacle, such as a glass or the like, into the dispensing cavity 14 to a position below the lower end of the discharge spout 40. As this is done, the receptacle will engage the lower end of the lever 94 and bias the same from the solid line position in FIG. 4 to the dotted line position. Such pivotal movement of the lever 94 will effect actuation of the switch assembly 112 and simultaneous pivotal movement of the discharge chute 76 from the solid line position to the dotted line position in FIG. 4. With the assembly 112 thus actuated, the drive motor assembly 62 will effect rotation of the inner bin 44, resulting in the mass of particulate ice contained therewithin moving across the discharge opening 72 and thereafter being directed by means of the discharge chute 76 downwardly into and through the spout 40 into the receptacle located therebelow. At such time as the vend cycle has been completed, the operator will remove the receptacle, resulting in the lever 96 being moved back to the solid line position of FIG. 4 and further resulting in deactuation of the drive motor assembly 62 and repositioning of the chute 76 back to the solid line position in FIG. 4 wherein any residual ice or melt water that may drop downwardly through the opening 72 may be directed into the lower end of the outer bin 30 and be subsequently communicated via a suitable drain conduit 126 and drain assembly 128 (see FIG. 3) to a suitable system drain.

It will be seen from the foregoing that the present invention provides a novel ice dispensing machine which features an improved ice discharge arrangement wherein any ice or melt water which may fall downwardly through the discharge opening will be conveyed directly to a system drain instead of falling through the discharge spout. The chute arrangement described herein will be seen to be of an extremely simple design and hence may be economically manufactured and will have a long and effective operational life. It will be appreciated, of course, that many alternative arrangements may be utilized for operatively connecting the control lever 94 with the chute 76 and control switch assembly 102 without departing from the scope or fair meaning of the subjoined claims and that the arrangement described hereinabove has been shown merely as a highly satisfactory method of carrying out the present invention.

Figure 7:
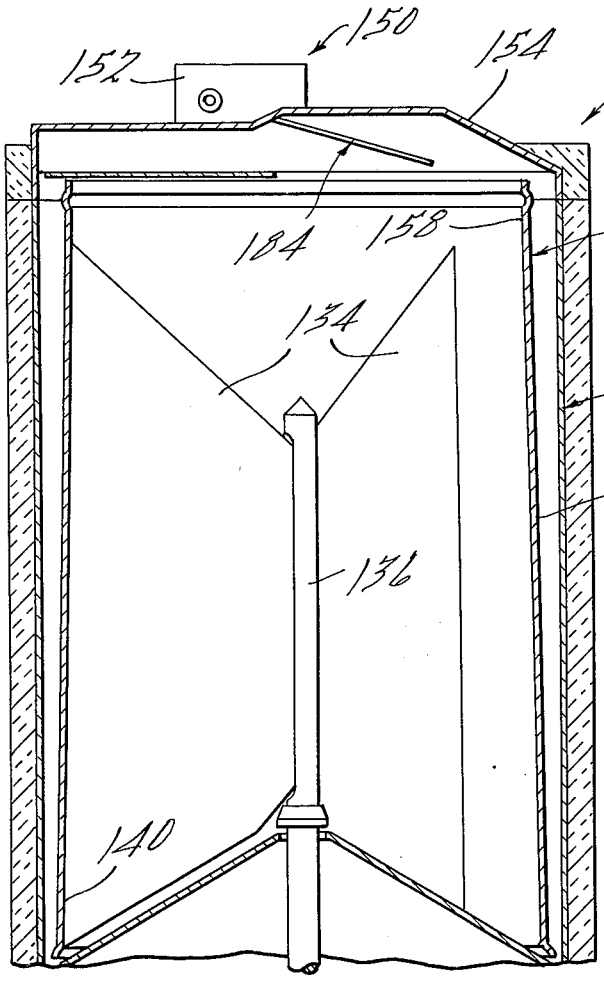
FIG. 7 is an enlarged fragmentary cross sectional view of a modified embodiment of the ice dispensing bin incorporated in the present invention.

Referring now in detail to FIG. 7, a slightly modified embodiment of the ice vend assembly 24 is shown and generally designated by the numeral 24'. As shown, the assembly 24' includes an inner ice bin assembly 130 which is operatively mounted within the outer bin 30 hereinabove described. The bin assembly 130 includes a bin member or side wall 132 which is operatively connected by means of a plurality of generally radially disposed vanes or partitions 134 to a central rotatable shaft 136. The vanes 134 and shaft 136 are analogous to the elements 50 and 54, respectively, hereinabove described, whereupon rotation of the shaft 136 due to energization of an associated vend motor, the entire bin member or side wall 132 will rotate within the outer bin 30 to cause ice disposed interiorly of the assembly 130 to move toward and through the associated discharge opening. In accordance with the present invention, the bin member or side wall 132 is provided with generally vertically spaced upper and lower end portions 138 and 140, respectively, the former of which is spaced radially closer to the rotational axis of the shaft 136 than the lower end portion 140. In particular, the side wall 132 is designed so as to be uniformly tapered or inclined radially outwardly from the upper end portion 138 thereof toward the lower end portion 140. The purpose of this construction is to assure against unobstructed ice movement from the upper end of the assembly 130 toward the lower end thereof, thus overcoming the tendency of some prior art designs, wherein the side wall is of a cylindrical configuration, i.e., constant radius, to have the ice mass become jammed.

Figure 9:
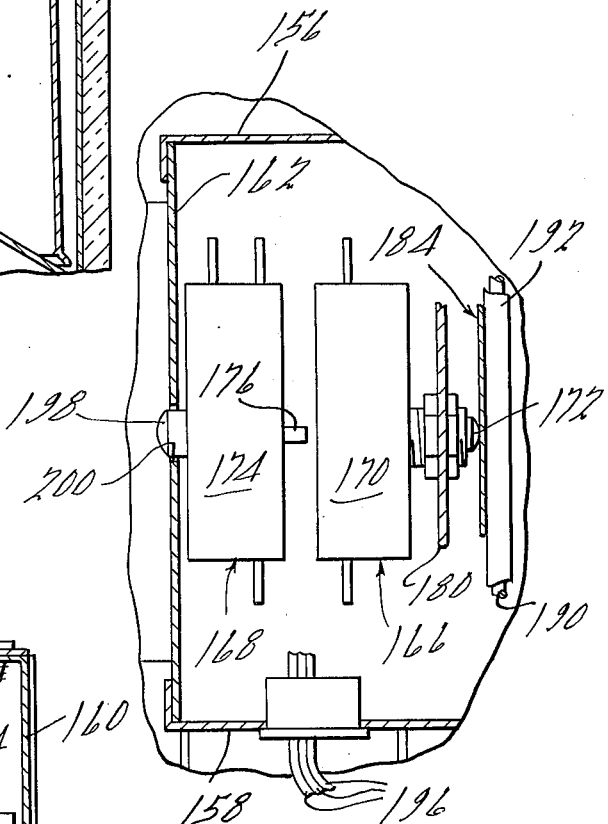
FIG. 9 is an enlarged fragmentary cross sectional view taken substantially along the line 9—9 of FIG. 8.
Figure 8:
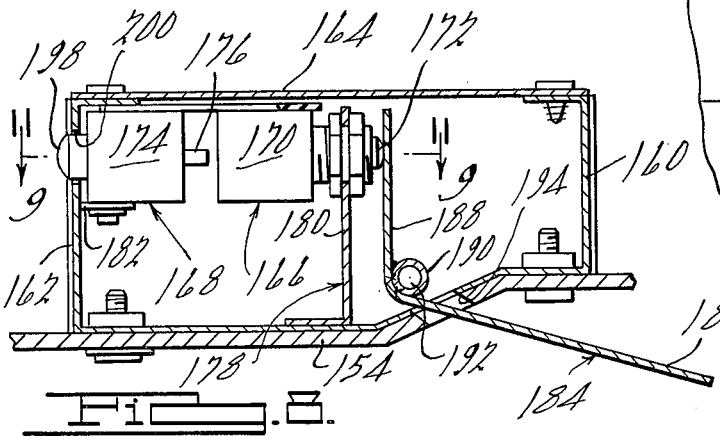
FIG. 8 is a cross sectional view of the ice level sensing assembly of the ice dispensing machine of the present invention.

In accordance with still additional features of the present invention, there is provided an ice level control assembly, generally designated by the numeral 150. As shown in FIG. 7, the assembly 150 comprises a housing or enclosure 152 operatively mounted upon the top or cover 154 of the assembly 28'. The housing 152 typically is of the generally rectangular configuration and includes spaced parallel side walls 156, 158 and end walls 160, 162 with the uppermost portion of the housing 152 being closed by a removable access panel 164. Disposed interiorly of the housing 152 is a pair of switch assemblies, generally designated by the numerals 166 and 168. As best shown in FIGS. 8 and 9, the switch assembly 166 comprises a housing 170 and a movable plunger or control member 172 which is adapted to be moved interiorly of the housing 172 to effect control of an electrical circuit with which the switch assembly 166 is operatively connected. In a similar manner, the switch assembly 168 includes a housing 174 and a movable or actuatable plunger or control member 166. In accordance with the present invention, the switch assembly 166 is operatively mounted upon the generally L-shaped mounting bracket, the lower end of which is affixed to the cover 154 and which includes an upwardly extending, generally flexible leg portion 180 upon which the assembly 166 is secured, with the result that the switch assembly 166 is movable within predetermined limits in a rightward and leftward direction in FIGS. 8 and 9, as will hereinafter be described. The switch assembly 168, on the other hand, is fixedly mounted within the housing 152 by means of a suitable mounting bracket or the like 182, as illustrated.

Operatively associated with the switch assemblies 166 and 168 is an ice engaging or sensing element generally designated by the numeral 184 which comprises a pair of angularly offset leg portions 186 and 188 which are connected to a sleeve-like intermediate member 190. The element 184 is preferably connected within the housing 152 by means of a suitable pivot pin or the like 192 extending through the member 190, whereby the element 184 is pivotable about a generally transversely extending axis defined by the pivot pin 192. As shown, the leg portion 186 of the element 184 extends downwardly through a suitable opening 192 in the cover 154 and is adapted to engage the upper surface of ice which is contained within the assembly. The leg portion 188, on the other hand, is engageable with the plunger 172 to effect actuation of the assembly 166, as will be described.

In operation of the present invention, the switch assemblies 166 and 168 are adapted to be operatively connected via suitable electrical conductors or the like 196 with the electrical circuit communicating electrical energy from a suitable source thereof to the associated ice producing system. As is conventional in the art, the vend assembly 28 is provided with means, such as a thermostatic sensing device, which senses when the quantity of ice within the bin assembly 130 drops below a predetermined level. When this occurs, the associated ice producing system 24 will be energized, whereby the flaked or particulate ice will be introduced into the bin assembly 130 as hereinabove described. At such time as the upper level of the ice within the bin assembly 130 reaches a predetermined level, the ice level sensing element 184 will be pivoted in a generally counterclockwise direction in FIG. 8 as the leg portion 186 thereof engages the upper surface of the ice. When this occurs, the upwardly extending leg portion 188 will bias the control member 172 of the switch assembly 166 toward the left in FIGS. 8 and 9, with the result that the switch assembly 166 will be actuated to effect opening of the aforesaid circuit and thus de-energization of the ice producing system 24. If, for any reason, the switch assembly 166 becomes inoperative, and is thus not effective in de-energizing the ice producing system 24, by virtue of the flexible characteristics of the leg portion 180 of the bracket 178, as the ice level within the assembly 130 moves upwardly, thereby causing the sensing element 184 to be pivoted in the abovedescribed manner, the entire switch assembly 166 will be biased toward the left in FIGS. 8 and 9, whereupon the housing 170 will engage and effect actuation of the control member 176 of the switch assembly 168. When this occurs, the switch assembly 168 is intended to become operative in effecting opening of the aforesaid circuit and thus de-energization of the ice producing system 24. Accordingly, it will be seen that the switch assembly 168 acts as a back-up or fail safe means for assuring that the ice producing system 24 will be de-energized when the volume or magnitude of the ice within the vend assembly 130 has reached a predetermined level. The switch assembly 168 is preferably designed so as to be manually resettable, and accordingly, is provided with a suitable "reset" button 198 which projects exteriorly of the housing 152 through a suitable aperture 200 formed in the end wall 162, as will be appreciated by those skilled in the art.

While it will be apparent that the preferred embodiments herein illustrated are well calculated to fulfill the objects stated, it will be appreciated that the present invention is susceptible to modification, variation and change without departing from the proper scope or fair meaning of the subjoined claims.

I claim:

1. In an apparatus for storing and dispensing ice in particulate form that is produced by an associated ice making machine, a generally cylindrical particulate ice storage compartment, a bottom closure for said compartment and means defining a discharge opening in said closure, means for moving ice within said compartments towards said opening, an electrical control circuit communicating a source of electrical energy with said ice making machine, a first switch connected to said circuit and having a switch body and an actuator, said actuator normally being disposed in a first position closing said circuit and movable relative to said body to a second position opening said circuit, a second switch normally disposed directly adjacent said first switch and connected to said circuit, said second switch having an actuator normally disposed in a first position closing said circuit and movable to a second position opening said circuit solely under the influence of said first switch body moving from said normal position to an actuated position, an ice engaging element pivotably mounted adjacent the upper end of said compartment and having a portion engageable with ice in said compartment and adapted to apply a force of a predetermined magnitude upon engagement of said ice therewith, a yieldable support member supporting said first switch at said normal position adjacent said second switch and permitting movement of said first switch from said normal position to said actuated position under the application of said force from said ice engaging element against said first switch actuator and under conditions when said first switch actuator is predeterminately inoperative, whereby when said predetermined inoperative condition exists and said element is engaged by ice within said container, said second switch actuator will be moved by said first switch to said second position opening said circuit to prevent operation of said ice making machine, and wherein said first switch is operatively supported by said body upon said yieldable support which comprises a relatively resilient member permitting movement of said first switch body toward and into engagement with said actuator of said second switch under the influence of said force being exerted against said first switch.

2. The invention as set forth in claim 1 which comprises an ice enclosure including a generally vertically disposed cylindrical side wall, means defining an ice discharge opening adjacent the lower end of said enclosure, an inner bin assembly disposed within said enclosure and adapted to cause ice therewithin to move toward said discharge opening, said bin assembly being rotatable within said bin about a generally vertical axis and including a side wall arranged concentrically of said first mentioned side wall, and said side wall of said inner bin assembly having axially spaced upper and lower end portions, with one of said end portions being located radially closer to said axis than the other of said end portions.

3. The invention as set forth in claim 2 wherein the uppermost of said end portions is spaced radially closer to said axis.

4. The invention as set forth in claim 2 wherein the end portion of said bin assembly side wall located closest to said discharge opening is spaced radially further from said axis than the other of said end portions.

5. The invention as set forth in claim 2 wherein said side wall of said inner bin assembly is uniformly tapered between said end portions.

6. The invention as set forth in claim 5 wherein the uppermost end portion of said inner bin assembly side wall is spaced radially closer to said axis than the lowermost of said end portions.

7. The invention as set forth in claim 2 wherein said inner bin assembly comprises a central shaft-like drive member, at least one radially extending element interconnecting said member with said side wall of said assembly, and wherein said element is operable upon rotation of said bin assembly to cause ice within said bin to move toward said discharge opening.

* * * * *